US005713819A

United States Patent [19]

Hsieh

[11] Patent Number: 5,713,819

[45] Date of Patent: Feb. 3, 1998

[54] BOUNCING EXERCISER WITH TORSION SPRINGS

[76] Inventor: Frank Hsieh, 9th-1 Floor, Kuang Fu South Road, Taipei, Taiwan

[21] Appl. No.: 719,370

[22] Filed: Sep. 25, 1996

[51] Int. Cl.[6] ..... A63B 26/00

[52] U.S. Cl. ..... 482/77; 482/127

[58] Field of Search ..... 482/26, 75–77, 482/127, 128, 30–32; 472/135

[56] References Cited

U.S. PATENT DOCUMENTS

| | | | |
|---|---|---|---|
| 3,065,962 | 11/1962 | Hoffmeister | 482/77 |
| 3,328,028 | 6/1967 | Williams | 482/77 |
| 3,377,722 | 4/1968 | Downing | 482/77 |
| 3,731,919 | 5/1973 | Schurch | 482/127 |
| 5,102,119 | 4/1992 | Gerlach | 482/77 |

FOREIGN PATENT DOCUMENTS

| | | | |
|---|---|---|---|
| 2671286 | 7/1992 | France | 482/77 |

*Primary Examiner*—Richard J. Apley
*Assistant Examiner*—Denise Pothier
*Attorney, Agent, or Firm*—Browdy and Neimark

[57] ABSTRACT

An exercise device comprises a handle rod, a foot board, a base board, and an elastic member. The handle rod is composed of an upper tube and a lower tube. The foot board is fastened with the upper tube while the base board is fastened with the lower tube. The elastic member is fastened between the foot board and the base board. The elastic member is composed of two or more torsion springs arranged symmetrically between the foot board and the base board. The torsion springs have an upper arm, a lower arm and a coiled body located between the upper arm and the lower arm such that the upper arm and the lower arm form a predetermined angle, and that the upper arm is fastened with the foot board, and further that the lower arm is fastened with the base board.

4 Claims, 7 Drawing Sheets

BOUNCING EXERCISER WITH TORSION SPRINGS

FIELD OF THE INVENTION

The present invention relates to an exercise device.

BACKGROUND OF THE INVENTION

As shown in FIG. 1, a prior art exercise device comprises a foot board 10, a ground board 20, and a cylindrical spring 30 which is fitted over the upright rod such that the spring 30 is located between the foot board 10 and the ground board 20, and that the spring 30 can be caused to compress by the weight of a person standing on the foot board 10. As shown in FIG. 2, the maximum extent of compression of the spring 30 is relatively small, as indicated by the letter "L" in FIG. 2. As a result, the prior art exercise device is capable of providing an exerciser with a relatively small jumping stroke. In addition, the foot board 10 is merely supported by the elastic force $F_1$ of the spring 30 and is therefore vulnerable to tilting at such time when the foot board 10 is exerted on by the force $F_2$ of the legs.

SUMMARY OF THE INVENTION

It is therefore the primary objective of the present invention to provide an exercise device devoid of the shortcomings of the prior art exercise device described above.

The foregoing objective of the present invention is attained by an improved exercise device, which comprises a handle, a foot board, a base board, and an elastic member having two or more torsion springs. Each of the torsion springs is fastened between the foot board and the base board to provide a greater jumping stroke and stability.

The objective, features, functions, and advantages of the present invention will be more readily understood upon a thoughtful deliberation of the following detailed description of the embodiments of the present invention in conjunction with the accompanying drawings.

DETAILED DESCRIPTION OF THE INVENTION

Figure 1:
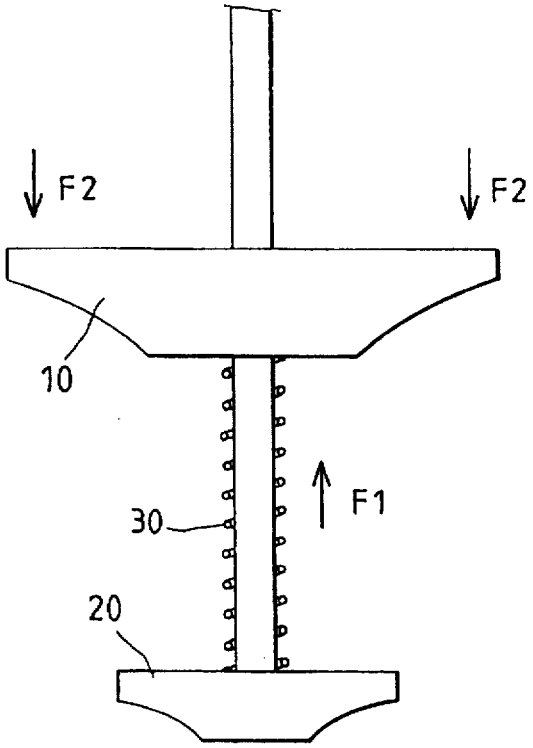
PRIOR ART FIG. 1
FIG. 1 shows a schematic view of an exercise device of the prior art.
Figure 2:
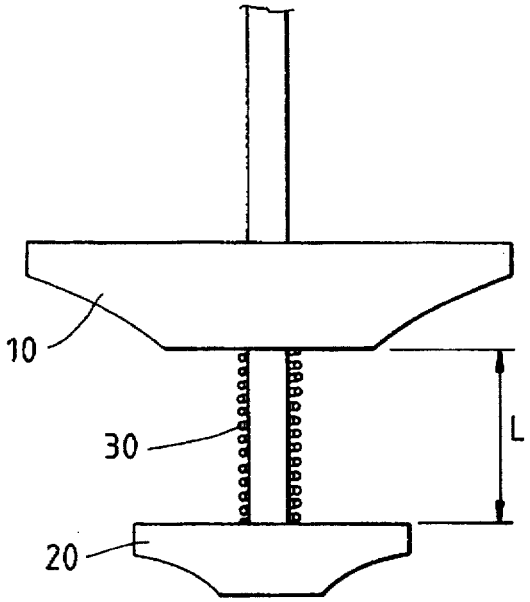
PRIOR ART FIG. 2
FIG. 2 is a schematic view illustrating the prior art at work.
Figure 3:
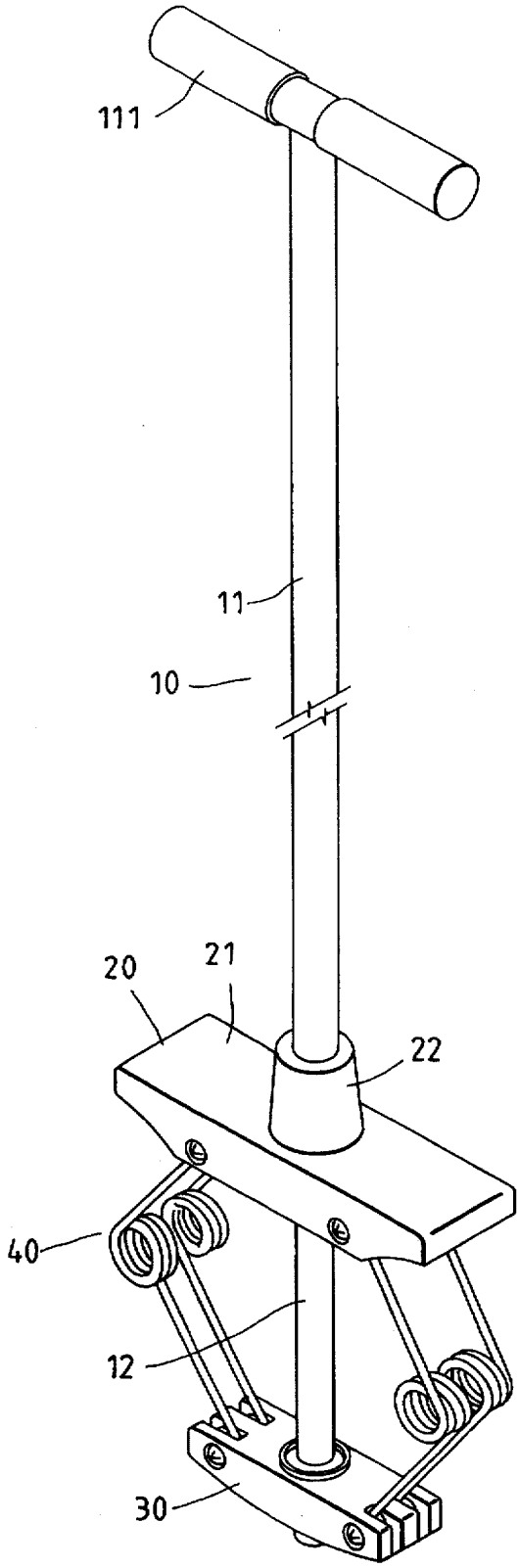
FIG. 3 shows a perspective view of a first preferred embodiment of the present invention.
Figure 4:
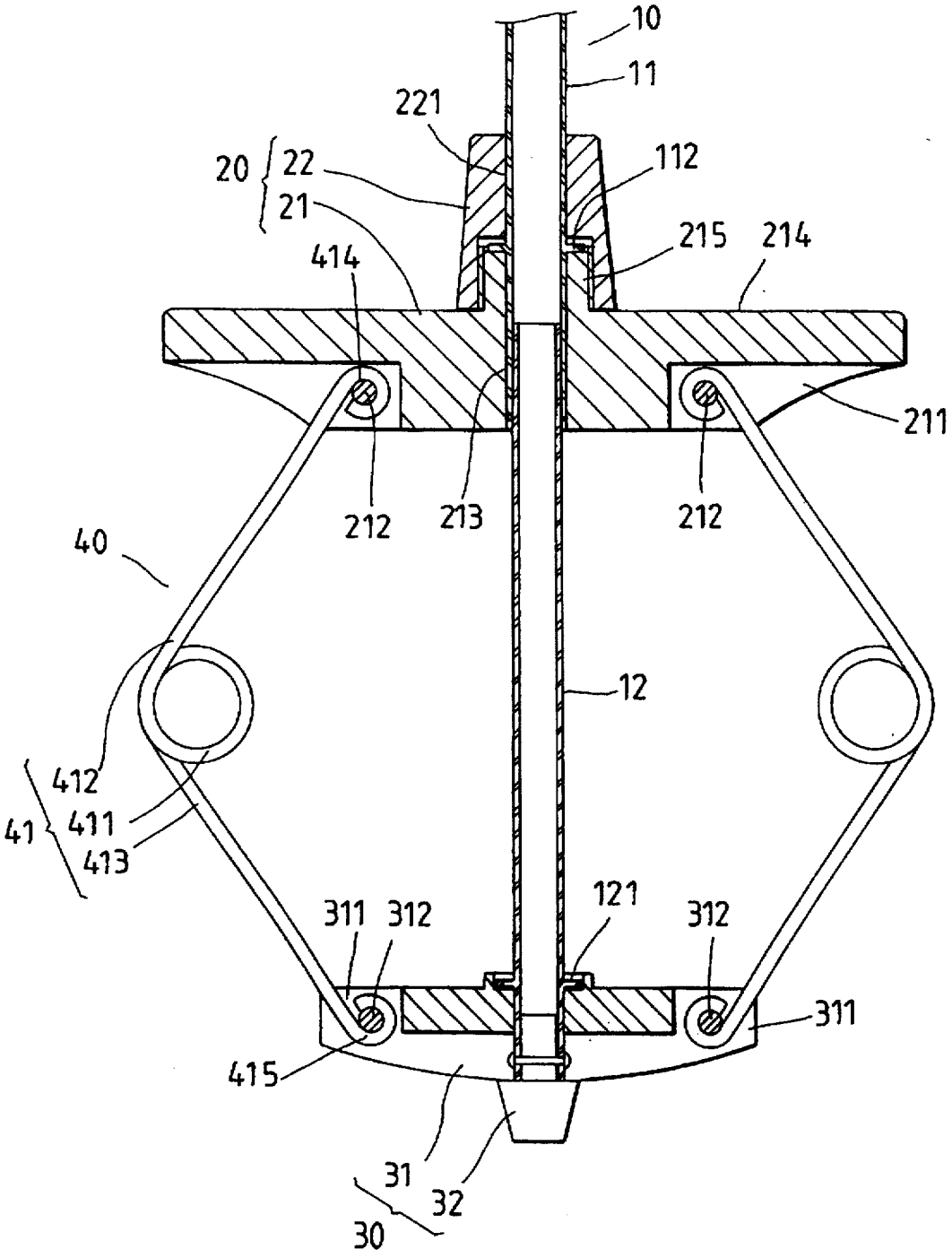
FIG. 4 is a longitudinal sectional view showing that the springs of the first preferred embodiment of the present invention are not compressed.
Figure 5:
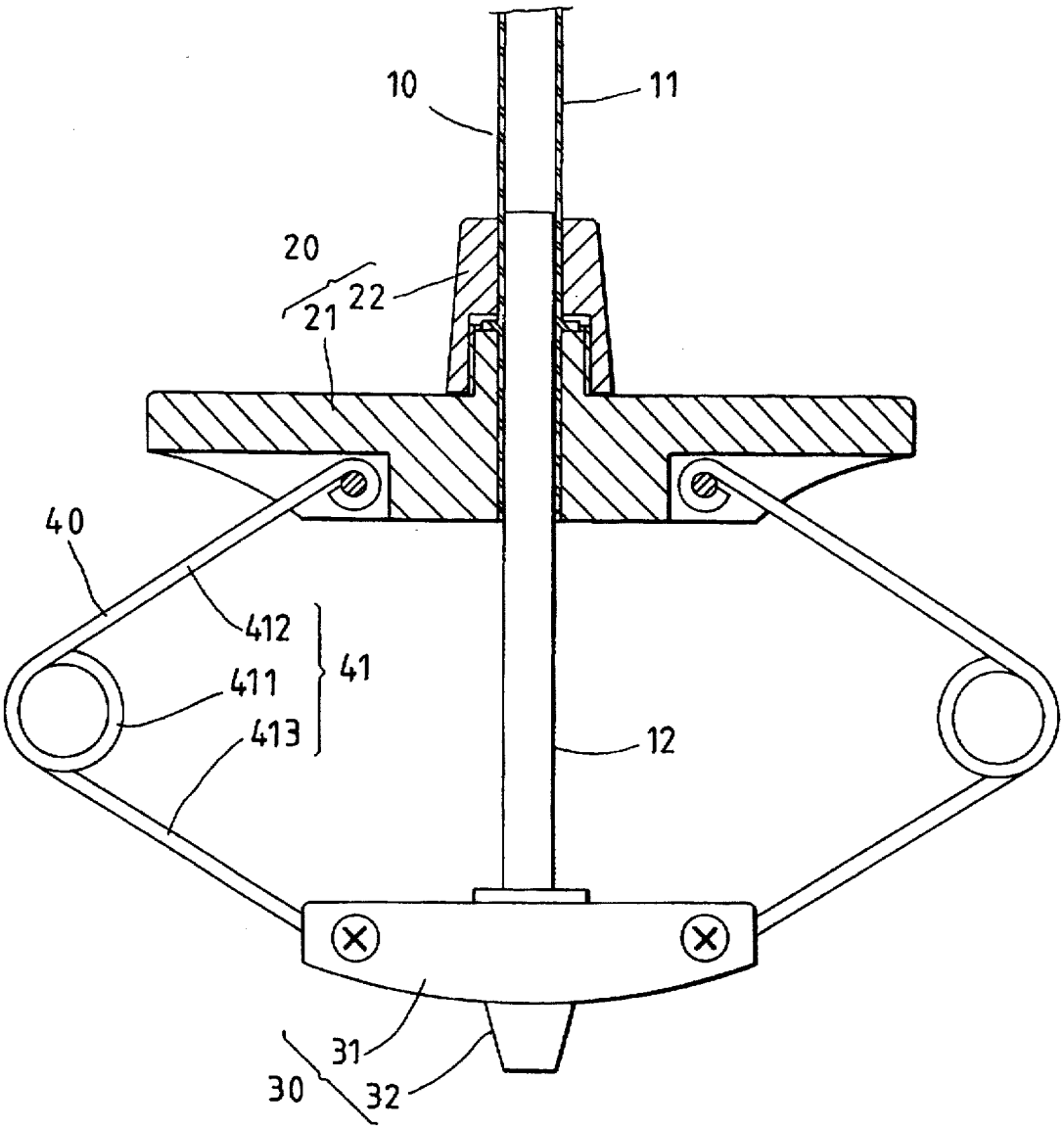
FIG. 5 is a longitudinal sectional view showing that the springs of the first preferred embodiment of the present invention are compressed.

As shown in FIGS. 3–5, an exercise device of the first preferred embodiment of the present invention comprises mainly a handle 10, a foot board 20, a base board 30, and an elastic member 40.

The handle 10 is made up of an upper tube 11 and a lower tube 12 which is slidably and coaxially fitted at the upper end thereof into the lower end of the upper tube 11. Fastened with the top end of the upper tube 11 is a hand grip 111. The upper tube 11 is provided peripherally at the bottom end thereof with a projected upper ring piece 112 while the lower tube 12 is provided peripherally at the bottom end thereof with a lower ring piece 121.

The foot board 20 has a tread 21 and a fastening sleeve 22. The tread 21 is provided in the underside thereof with a plurality of ribbed panels 211. Each of the ribbed panels 211 is provided with a plurality of locating projections 212. The tread 21 is further provided axially with a through hole 213, which is engaged with the upper tube 11, a flat portion 214 and a protruded portion 215. The flat portion 214 is intended for use in providing a treading space. The protruded portion 215 is provided peripherally with a male threaded portion which is engaged with a female threaded portion of the fastening sleeve 22. The fastening sleeve 22 is provided with a through hole 221 extending in the direction of the longitudinal axis thereof. The tread 21 is engaged with the bottom end of the upper tube 11 such that the protruded portion 215 engages the upper ring piece 112 of the upper tube 11.

The base board 30 has a bottom piece 31 and a padded block 32. The bottom piece 31 is provided longitudinally with a plurality of ribbed panels 311 having four locating projections 312 which are corresponding in location to the locating projections 212 of the tread 21. The padded block 32 of a plastic material is provided round peg in shape and secured to the lower tube 12 such that the tread 31 is pressed against by the padded block 32, and that the lower ring piece 121 of the lower tube 12 is urged by the padded block 32.

The elastic member 40 has four torsion springs 41 having a coiled body 411. The coiled body 411 is provided with an upper arm 412 and a lower arm 413 equal in length to the upper arm 412. The upper arm 412 is provided at one end thereof with a hooked portion 414 while the lower arm 413 is provided at one end thereof with a hooked portion 415. The hooked portion 414 is corresponding in location to the locating projection 212 of the tread 21 while the hooked portion 415 is corresponding in location to locating projection 312 of the tread 31. The coiled body 411 is located at the outer end side of the locating projections 212 and 312. The upper arm 412 and the lower arm 413 form a predetermined angle.

The present invention is characterized in design in that the tread 20 and the base board 30 are provided therebetween with the torsion springs 41 which are located symmetrically to enable the tread 20 and the base board 30 to have a greater reciprocating displacement, thereby maximizing the jumping stroke of the device of the present invention. In operation, an exerciser treads on the tread 21 of the foot board 20 such that his or her hands hold the hand grips 111. The torsion springs 41 are caused to deform by the weight of the exerciser such that the bodies 411 of the torsion springs 41 are caused to displaced outwards, as shown in FIG. 5. The device of the present invention can be easily controlled by the exerciser in view of the fact that the torsion springs 41 are arranged symmetrically between the foot board 20 and the base board 30, thereby minimizing the incident that the foot board 20 is caused to tilt. It must be noted here that the torsion springs 41 are arranged securely between the foot board 20 and the base board 30 by means of the hooked portions 414 and 415 of the torsion springs 41, which are engaged respectively with the locating projections 212 of the foot board 20 and the locating projections 312 of the base board 30.

Figure 6:
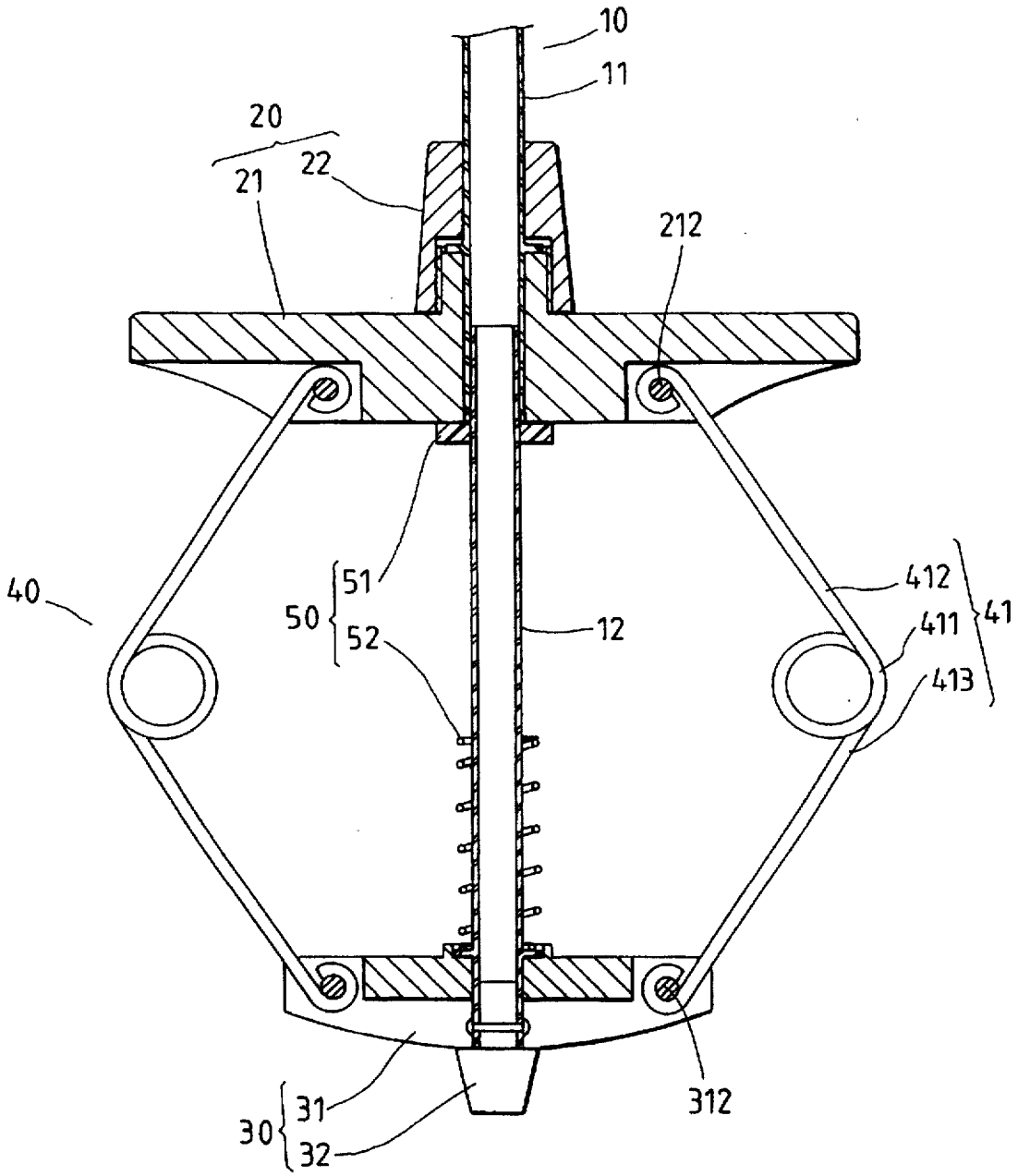
FIG. 6 shows a schematic view of a second preferred embodiment of the present invention.

As shown in FIG. 6, a device of the second preferred embodiment of the present invention comprises a buffer member 50, which is located between the foot board 21 and the base board 31 and is composed of a buffer board 51 and a buffer spring 52. The buffer member 50 gives an added shock-absorbing effect.

Figure 7:
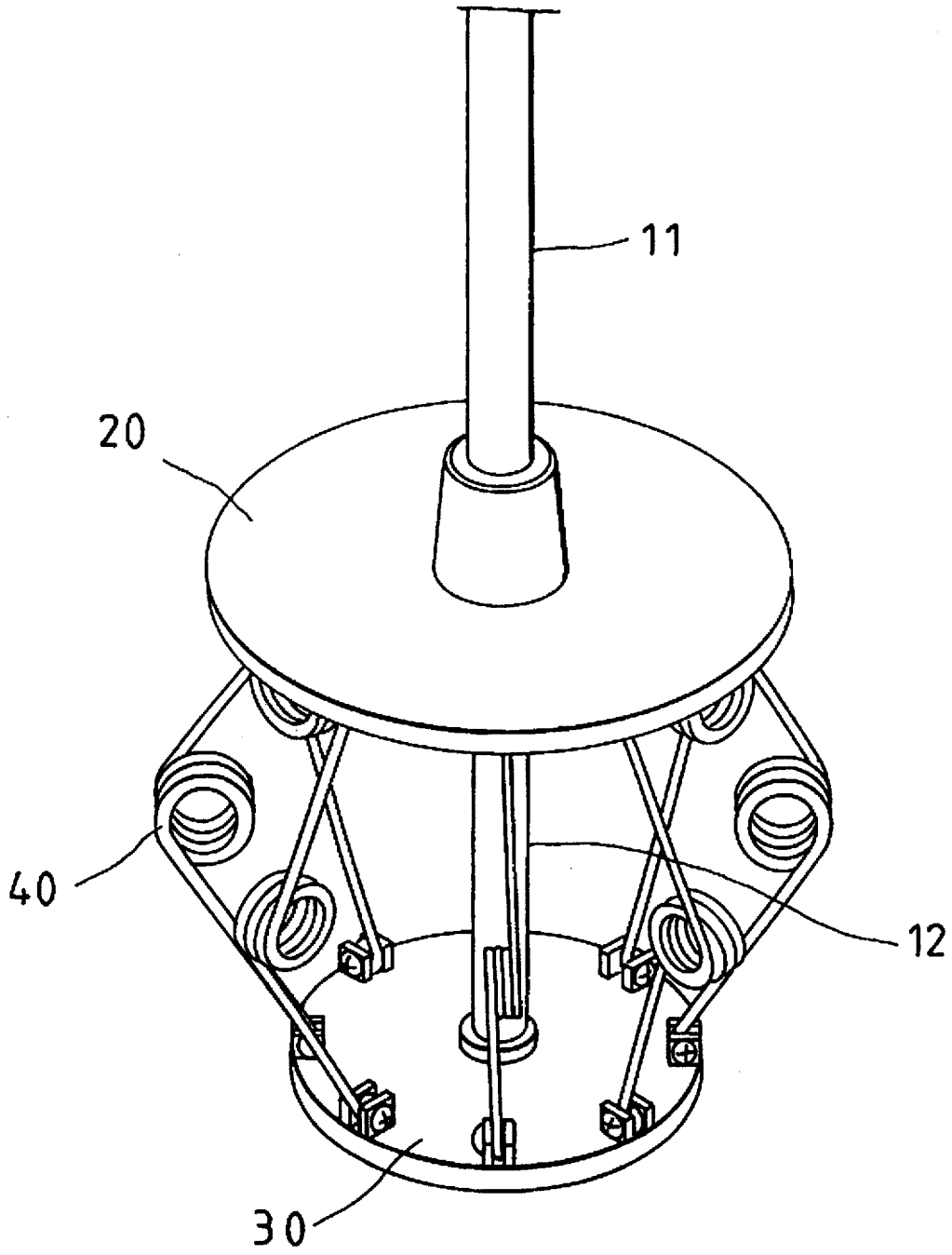
FIG. 7 shows a perspective view of a third preferred embodiment of the present invention.

As shown in FIG. 7, a device of the third preferred embodiment of the present invention is different from the devices of the first and the second preferred embodiments of the present invention in that the former comprises a foot board 20 and a base board 30, which are round in shape. The foot boards 20 and the base boards 30 of the first and the second preferred embodiments of the present invention have a rectangular upper panel. In addition, the device of the third preferred embodiment of the present invention comprises a plurality of elastic members 40.

Figure 8:
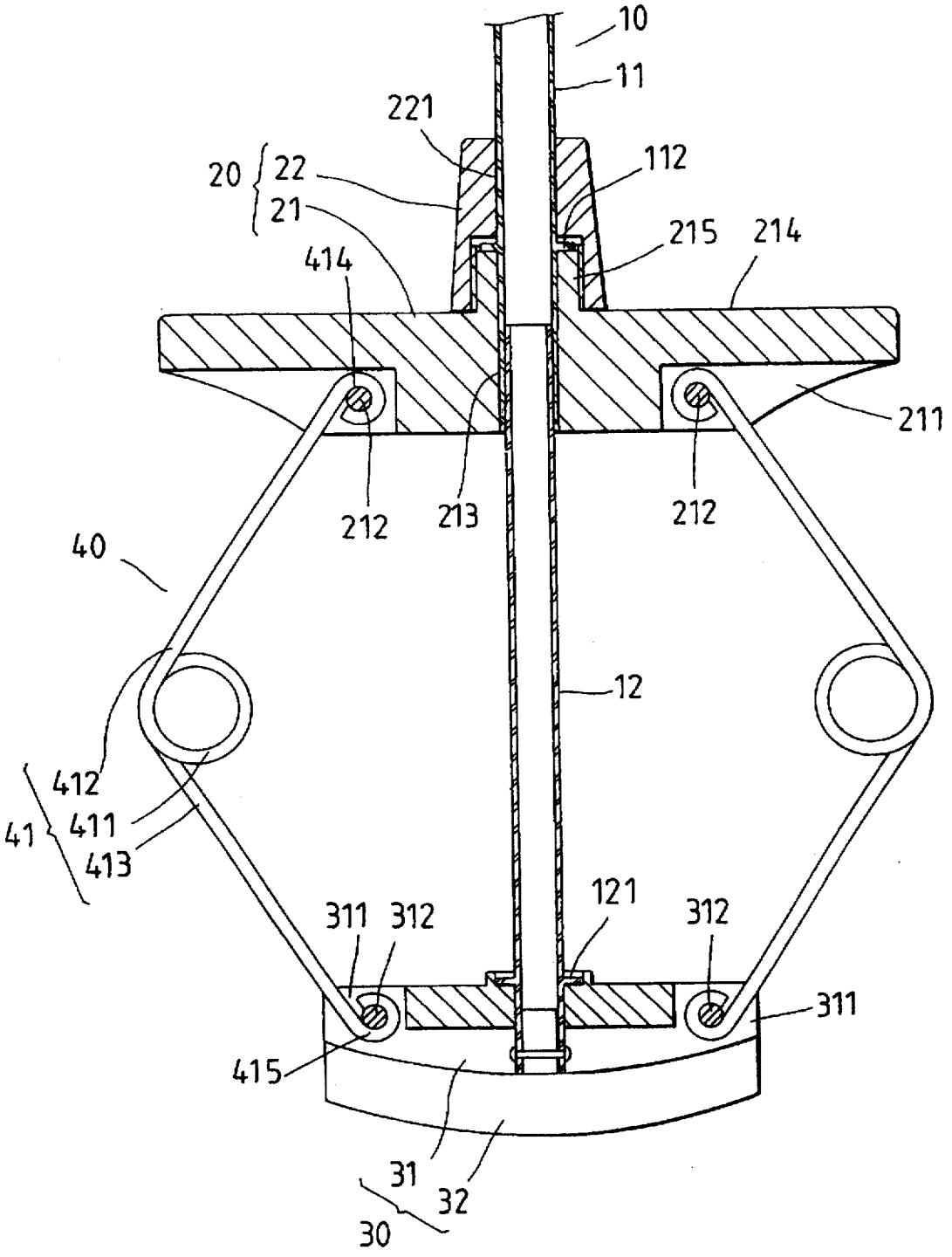
FIG. 8 is longitudinal section view of a fourth preferred embodiment.

As shown in FIG. 8, a device of the fourth preferred embodiment of the present invention is different from the devices of the first, second and third preferred embodiments of the present invention in that the former comprises a padded block 32 of a plastic material, which is provided longitudinal panel in shape.

The advantages of the device of the present invention include a greater jumping stroke, an excellent stability, and an excellent controllability, thanks to the fact that the force of legs treading the foot board 20 is directly proportional to the torsion angle of the torsion springs 41.

The embodiments of the present invention described above are to be regarded in all respects as being merely illustrative and not restrictive. Accordingly, the present invention may be embodied in other specific form without deviating from the spirit thereof. The present invention is therefore to be limited only by the scopes of the following appended claims.

What is claimed is:

1. An exercise device comprising:

a handle rod having an upper tube and a lower tube fitted slidably and coaxially into a lower end of said upper tube, said upper tube provided at an upper end thereof with a hand grip fastened therewith;

a foot board with said lower end of said upper tube;

a base board fastened with a lower end of said lower tube; and an elastic member fastened between said foot board and said base board;

wherein said elastic member is composed of two or more torsion springs arranged symmetrically between said foot board and said base board and spaced opposite each other outside a periphery of said handle rod, said torsion springs having an upper arm fastened with said foot board, said torsion springs further having a lower arm fastened with said base board, said torsion springs still further having a coiled body located between said upper arm and said lower arm such that said upper arm and said lower arm form a predetermined angle of less than 180°, wherein when an exerciser jumps on said footboard, a plane of said footboard moves toward said base board along a longitudinal direction of said upper tube and said lower tube while said two or more torsion spring are each equally compressed.

2. The exercise device as defined in claim 1, wherein said upper arm and said lower arm of said torsion springs are equal in length to each other.

3. The exercise device as defined in claim 1 further comprising a buffer member fastened between said footboard and said base board.

4. The exercise device as defined in claim 3, wherein said buffer member comprises a buffer board fastened with said foot board, and a buffer spring fastened with said base board.

* * * * *